US006188370B1

(12) United States Patent
Lange

(10) Patent No.: US 6,188,370 B1
(45) Date of Patent: Feb. 13, 2001

(54) GRID ANTENNAS AND METHODS WITH EFFICIENT GRID SPACING

(75) Inventor: Mark J. Lange, Camarillo, CA (US)

(73) Assignee: California Amplifier, Inc., Camarillo, CA (US)

( * ) Notice: Under 35 U.S.C. 154(b), the term of this patent shall be extended for 0 days.

(21) Appl. No.: 09/339,438

(22) Filed: Jun. 24, 1999

(51) Int. Cl.[7] ..... H01Q 19/12
(52) U.S. Cl. ..... 343/840; 343/912; 343/916
(58) Field of Search ..... 343/840, 909, 343/911 R, 912, 916

(56) References Cited

U.S. PATENT DOCUMENTS

| | | | | |
|---|---|---|---|---|
| 2,597,339 | * | 5/1952 | Krutter | 343/840 |
| 2,729,816 | * | 1/1956 | Crawford | 343/753 |
| 2,850,735 | | 10/1958 | Harris | 343/840 |
| 3,178,713 | * | 4/1965 | Yang | 343/840 |
| 4,405,928 | | 9/1983 | Elsbernd | 343/912 |
| 4,801,946 | * | 1/1989 | Mats, Jr. | 343/840 |
| 5,291,212 | * | 3/1994 | Cox | 343/840 |
| 5,380,328 | * | 1/1995 | Morgan | 606/70 |
| 5,894,290 | * | 4/1999 | Oona et al. | 343/840 |

OTHER PUBLICATIONS

Jasik, Henry, *Antenna Engineering Handbook,* Mc–Graw Hill, Inc., New York, 1993, pp. 17–17 to 17–22, 27–12 to 27–13 and 46–2 to 46–9.

Bulletin No. G–992, Microwave Grid Antennas 335–2700 MHz, *Radiation Systems,* Inc.—*Mark Antennas Division.*

Specification Sheets for Super Grid, GP Series and GridPak Antennas, *Andrew Microwave.*

Stutzman, Warren, et al., *Antenna Theory and Design,* JohnWiley and Sons., New York, 1981, pp. 433–434.

* cited by examiner

*Primary Examiner*—Don Wong
*Assistant Examiner*—Trinh Vo Dinh
(74) *Attorney, Agent, or Firm*—Koppel & Jacobs

(57) ABSTRACT

Paraboloidal grid reflectors and antennas are provided which are lighter and have less wind loading because they efficiently realize selected front-to-back ratios by recognizing the angular distribution in typical differential path losses and feed gains. In particular, the reflectors are formed with adjacent pairs of parallel elongate members that are positioned at respective angles θ from the paraboloidal vertex and spaced apart by respective spaces S that generally increase with increased angle θ. In some reflector embodiments, the spaces S increase with increased angle θ for a contiguous majority of adjacent pairs and may be constant for a contiguous minority that typically adjoins the vertex. In other reflector embodiments, the spaces S increase with increased angle θ for all of the adjacent pairs.

36 Claims, 7 Drawing Sheets

| MEMBER NUMBER | LOCATION | SPACE |
|---|---|---|
| RIM | 19.50 | 1.22 |
| 27 | 18.28 | 1.10 |
| 26 | 17.18 | 1.03 |
| 25 | 16.13 | 1.00 |
| 24 | 15.13 | 0.95 |
| 23 | 14.18 | 0.91 |
| 22 | 13.27 | 0.88 |
| 21 | 12.39 | 0.85 |
| 20 | 11.54 | 0.82 |
| 19 | 10.72 | 0.78 |
| 18 | 9.94 | 0.76 |
| 17 | 9.18 | 0.73 |
| 16 | 8.45 | 0.70 |
| 15 | 7.75 | 0.66 |
| 14 | 7.09 | 0.62 |
| 13 | 6.47 | 0.61 |
| 12 | 5.86 | 0.58 |
| 11 | 5.28 | 0.57 |
| 10 | 4.71 | 0.56 |
| 9 | 4.15 | 0.55 |
| 8 | 3.60 | 0.54 |
| 7 | 3.06 | 0.53 |
| 6 | 2.53 | 0.52 |
| 5 | 2.01 | 0.51 |
| 4 | 1.50 | 0.50 |
| 3 | 1.00 | 0.50 |
| 2 | 0.50 | 0.50 |
| 1 | 0.00 | ----- |

GRID ANTENNAS AND METHODS WITH EFFICIENT GRID SPACING

BACKGROUND OF THE INVENTION

1. Field of the Invention

The present invention relates generally to antennas and, more particularly, to paraboloidal grid antennas.

2. Description of the Related Art

An especially useful configuration for an antenna reflector is that of a paraboloid which is generated by rotating the arc of a parabola about its axis. In a feature of this structure, electromagnetic energy transmitted from the paraboloidal focus to the paraboloidal surface is collimated or, equivalently, received collimated energy is reflected from the paraboloidal surface to the paraboloidal focus. One performance characterization of paraboloidal grid antennas is the front-to-back ratio which is a ratio of maximum gain in the antenna's forward hemisphere to maximum gain in its rear hemisphere. This ratio is typically approximated by a power ratio of the main lobe to the rear lobe.

Paraboloidal reflectors have been constructed by replacing a solid paraboloidal surface with one formed by parallel grid members that are aligned with the polarization of a received signal. The grid members are spaced by a common space that is typically calculated to realize a selected front-to-back ratio. Although this replacement generally reduces total aperture efficiency (e.g., from a range of 0.5 to 0.7 to a range of 0.45 to 0.65) and degrades front-to-back ratio (e.g., on the order of 3 dB), it significantly lowers weight and wind loading and reduces the difficulty and cost of antenna installation.

An early description of paraboloidal grid reflectors is found in U.S. Pat. No. 2,850,735 to Harris. In order to reduce the rear lobe and thereby enhance the front-to-back ratio, U.S. Pat. No. 4,801,946 to Matz elongated each grid member in a direction parallel to the paraboloidal axis. In order to further reduce wind loading, U.S. Pat. No. 4,405,928 to Elsbernd provided the grid members with streamlined cross sections.

Modern communication systems (e.g., terrestrial digital video delivery systems) have increased the performance requirements of paraboloidal grid antennas. For example, cellular communication systems with advanced modulation techniques (e.g., quadrature amplitude modulation) and closely-spaced multiple transmitters require high front-to-back ratios (e.g., >26 dB) for subscriber antennas in order to avoid unacceptable co-channel interference and mulitpath reception.

Conventional paraboloidal grid antennas that can meet these front-to-back ratios require a large number of grid elements which increases their manufacturing cost. Because this also increases their weight and wind loading, they require more complex support structures which not only are more expensive but increase antenna installation costs.

SUMMARY OF THE INVENTION

The present invention is directed to paraboloidal grid antennas that are lighter, have less wind loading, are less expensive and are easier to install because they recognize angular variations in antenna parameters (e.g., feed gains and path losses) and use these variations to efficiently space elongate members to realize selected front-to-back radiation ratios.

In accordance with the invention, a method for achieving a selected front-to-back ratio F/B includes a first step of providing parallel elongate members that are shaped and positioned to lie upon the surface of an imaginary paraboloid that has a focus and a vertex. Thus, the elongate members have a main lobe gain $G_{ml}$ and a differential path loss $L_{d_\theta}$ from the focus that varies with an angle θ from the vertex. In another step, an electromagnetic feed signal is radiated from the focus with a polarization substantially parallel to the elongate members and with a feed gain $G_{f_\theta}$ that varies with the angle θ.

From the main lobe gain $G_{ml}$, the differential path loss $L_{d_\theta}$ and the feed gain $G_{f_\theta}$, a transmission coefficient $T_\theta$ is determined, as a function of the angle θ, that realizes the selected front-to-back ratio F/B. Respective cross sections are then chosen for the elongate members and, based on their respective cross sections, adjacent pairs of the elongate members are spaced by different spaces S that realize the transmission coefficient $T_\theta$ at respective angles θ.

In paraboloidal reflectors of the invention, adjacent pairs of elongate members are positioned at respective angles θ from the paraboloidal vertex and spaced apart by respective spaces S that increase with increased angle θ for at least two of the adjacent pairs. Generally, the spaces S increase with increased angle θ for a contiguous majority of adjacent pairs and may be constant for a contiguous minority that typically adjoins the vertex. In other reflector embodiments, the spaces S increase with increased angle θ for all of the adjacent pairs.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1B:
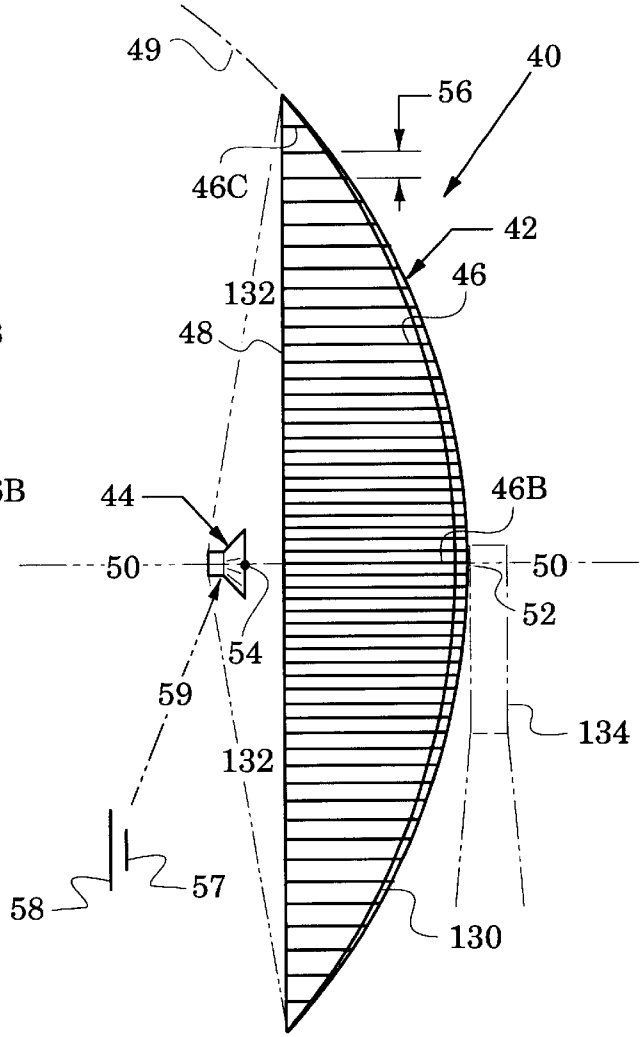
FIGS. 1A and 1B are front and side views of a paraboloidal antenna of the present invention.
Figure 1A:
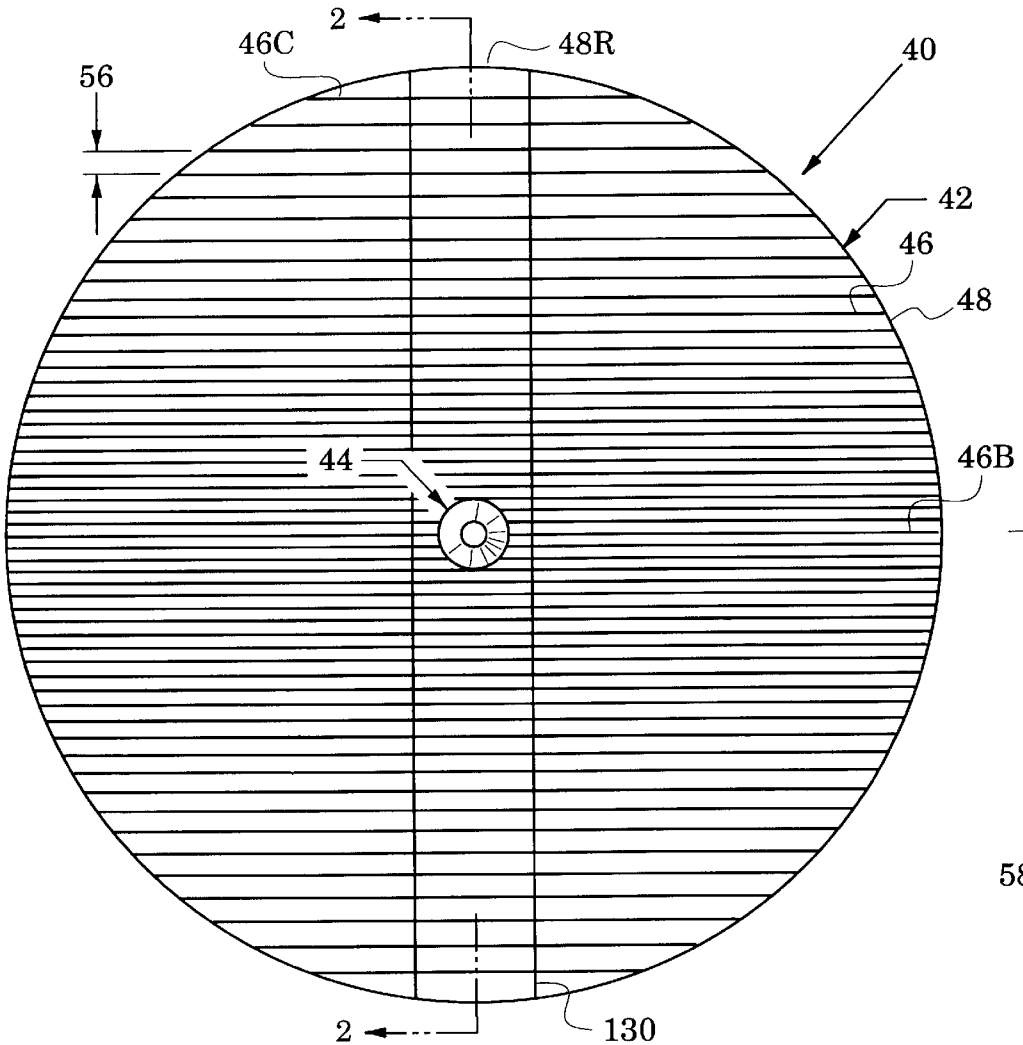
Figures 2, 3:
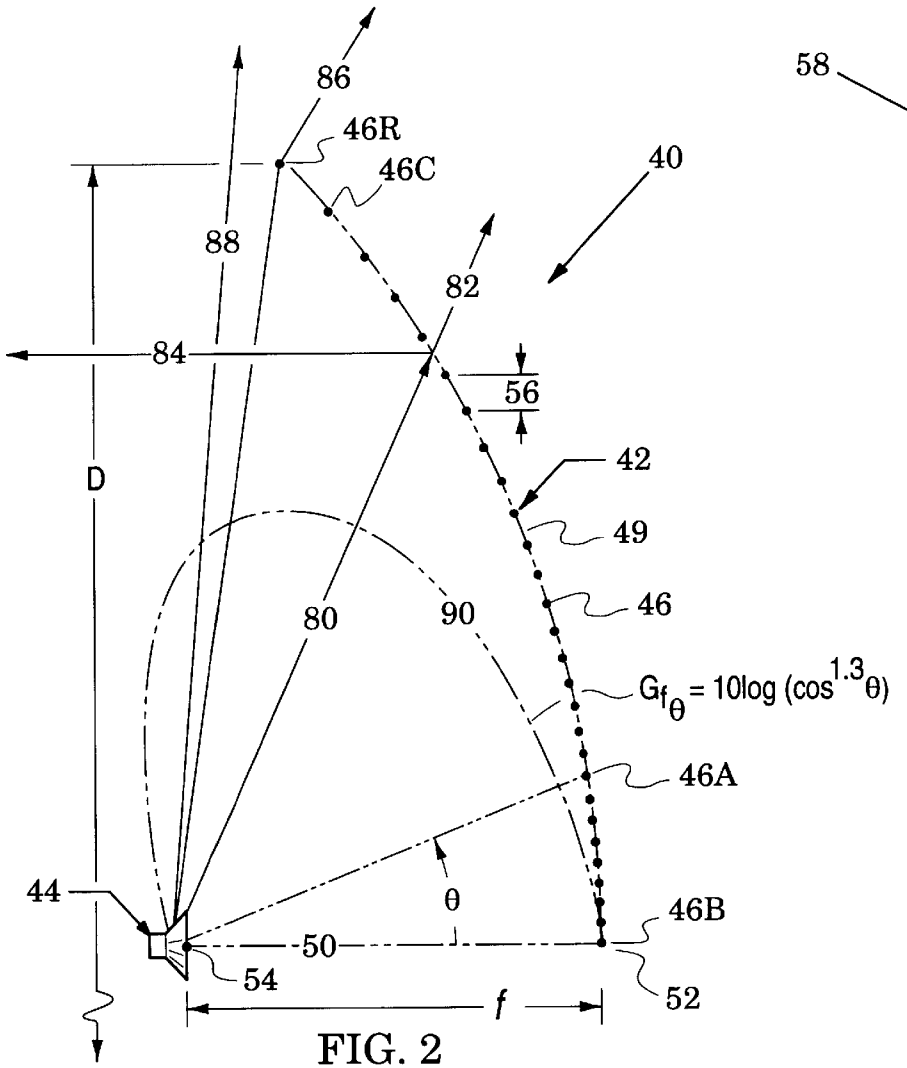
FIG. 2 is the upper half of a view along the plane 2—2 of FIG. 1A.
FIG. 3 is a table that shows exemplary wire locations in the view of FIG. 2.

FIGS. 1A, 1B and 2 illustrate an antenna 40 of the present invention that includes a paraboloidal reflector 42 and a feed 44. The reflector is formed with a plurality of conductive elongate members 46 that are substantially parallel and are supported at their ends by a conductive rim 48. The elongate members are shaped and positioned to lie upon the surface of an imaginary paraboloid 49 (shown in FIGS. 1B and 2)

that has an axis 50, a vertex 52 and a focus 54. The feed 44 is positioned at the focus 54 and as particularly shown with member 46A in FIG. 2, each elongate member is positioned at an angle θ from the vertex 52. The reflector has a focal length f that is the distance between the vertex 52 and the focus 54 and has an aperture diameter D that is the diameter of the rim 48 (f and D are shown in FIG. 2).

In a feature of the invention, the antenna 40 realizes a selected front-to-back ratio with adjacent pairs of the elongate members 46 being positioned at respective angles θ and spaced by respective spaces 56 that generally increase with increased angle θ. With this efficient spacing, the reflector has significantly fewer members than a conventional antenna that realizes the same front-to-back ratio. Accordingly, it is lighter, has less wind loading and can be supported on a lighter mounting structure. Antennas of the invention are thus less expensive and easier to install than conventional antennas.

Antenna embodiments of the invention can be realized with any feed that is suitable for illuminating paraboloids. An exemplary feed is the waveguide horn that is shown in FIGS. 1A and 1B. Another exemplary feed is the dipole 57 and reflector member 58 shown in FIG. 1B. The dipole typically has a length on the order of λ/2 in which λ is the signal wavelength. The reflector member typically has dimensions on the order of λ and may, for example, be an elongate member or a plate. When used for the feed, the dipole and reflector member would be substituted for the waveguide horn as indicated by the broken substitution arrow 59.

A prototype antenna similar to FIGS. 1A and 1B and a conventional grid antenna were fabricated and tested with a dipole feed. Both antennas had an f/D ratio of ~0.28 and were designed to have a main beamwidth of ~8.5° and a front-to-back ratio of ~30 dB when operated at ~2.612 GHz. Accordingly, the prototype and the conventional reflector both had an aperture diameter of ~39 inches.

The elongate members of the prototype had member locations and spaces as shown in table 58 of FIG. 3 wherein member numbers 1, 27 and "RIM" are respectively members 46B, 46C and 46R of FIGS. 1A, 1B and 2. The member 46R is that portion of the rim 48 that is substantially parallel to its adjacent member 46B (e.g., see FIG. 1A). The prototype thus had 53 members (not including the two "RIM" members) Because they could be easily joined (e.g., by spot welding) and have sufficient conductivity, steel wires were used to form the reflector with the elongate members 46 and the rim 48 having respective diameters D of ~0.114 inches and 0.250 inches. The prototype reflector had a weight of ~8.5 pounds (~3.86 kilograms). Other conductive members could be used to form the invention's reflectors, e.g., aluminum and copper members.

As stated above, antennas of the invention realize selected front-to-back ratios with pairs of elongate members being positioned at respective angles θ and spaced by respective spaces S that generally increase with increased angle θ. For various practical reasons (e.g., manufacturing tolerances and local variations in the feed gain), a minority of contiguous pairs may have constant spacing S as indicated in FIG. 3 for members 1 through 4. Typically, this contiguous minority will adjoin the vertex (52 in FIG. 2).

Generally, the space S will increase with increased angle for a contiguous majority of said adjacent pairs as indicated in FIG. 3 for members 5 through "RIM" and generally the contiguous majority adjoins the rim or margin of the imaginary paraboloid. In other antenna embodiments, the space S may increase with increased angle θ for all of the adjacent pairs.

Figure 4A:
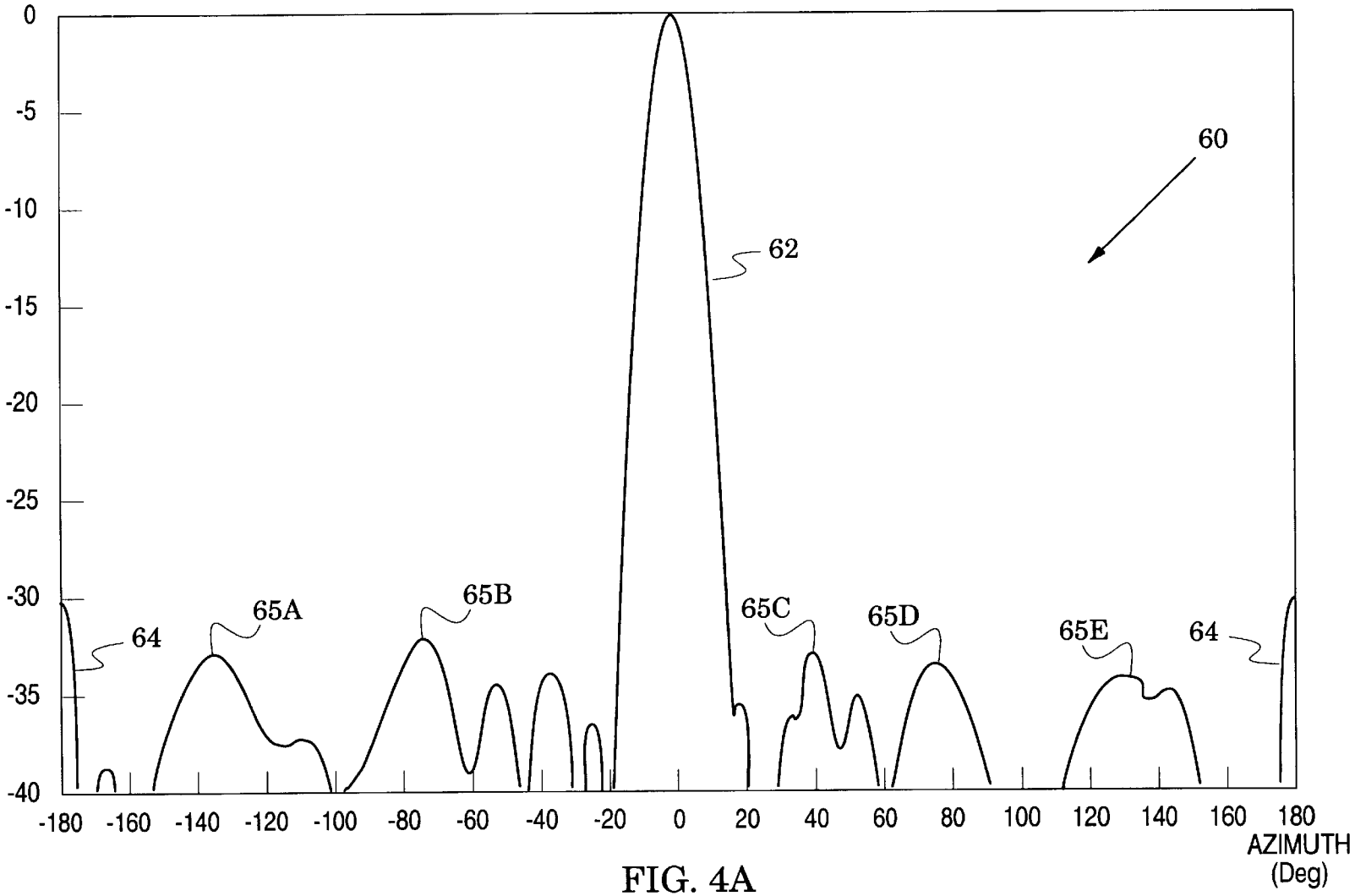
FIGS. 4A and 4B are radiation patterns measured respectively on a prototype of the antenna of FIGS. 1A and 1B and on a conventional paraboloidal grid antenna.

FIG. 4A shows a radiation pattern 60 that was obtained when the prototype of the invention was illuminated with a 2.612 GHz signal. The main lobe 62 was ~30 dB greater than the rear lobe 64 with all other lobes (e.g., the lobes 65A–65E) in the front and rear hemispheres reduced by at least 32 dB from the main lobe. Front-to-back ratio is generally considered to be the ratio of power gain between the front and rear hemispheres of an antenna so that the front-to-back ratio of the invention's prototype antenna is substantially the ratio of the main lobe 62 to the rear lobe 64 which is ~30 dB.

Various references (e.g., Jasik, Henry, *Antenna Engineering Handbook*, Mc-Graw Hill, Inc., New York, 1993, pp. 30–18, 30–19 and 46-2 to 46-9) teach paraboloidal grid reflectors with a fixed space between all members wherein the space is determined by the transmission coefficient required to realize a selected front-to-back ratio without regard to angular variations in antenna parameters (e.g., feed taper and differential path loss). In accordance with these teachings, the conventional reflector was fabricated with all of its members spaced by 0.5 inches, i.e., the spacing for member number 2 in FIG. 3. Accordingly, the conventional reflector had 75 members (which, again, does not include the two "RIM" members) and a weight of ~10.5 pounds (~4.76 kilograms).

Figure 4B:
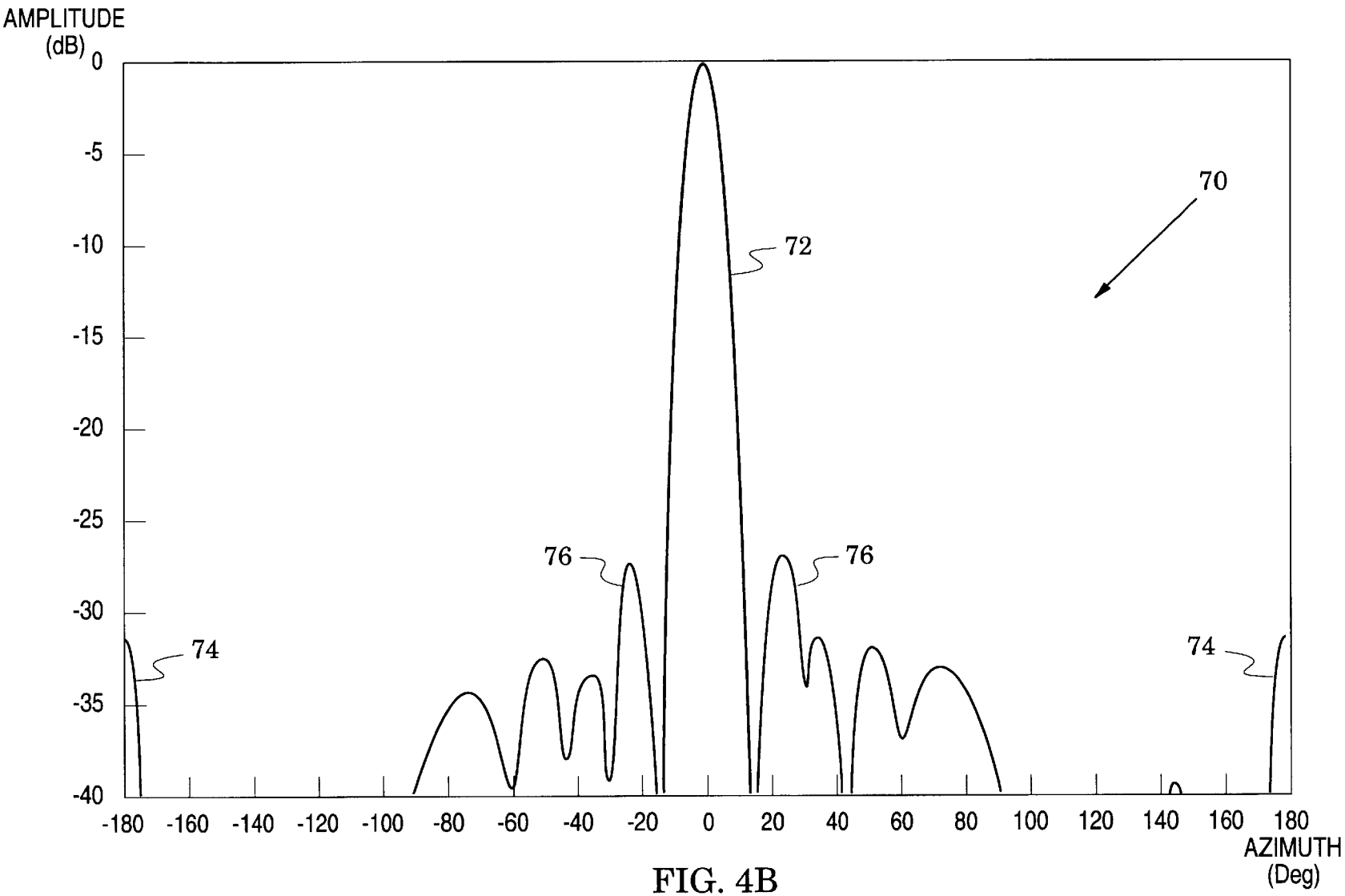

FIG. 4B shows a radiation pattern 70 that was obtained when this reflector was illuminated with a 2.612 GHz signal. The front-to-back ratio between the main lobe 72 and the rear lobe 74 is ~31 dB. As opposed to the invention's prototype, the first sidelobes 76 in the front hemisphere are ~27 dB below the main lobe.

Because the prototype of FIGS. 1A and 1B efficiently spaced its elongate members, it reduced the number of members by ~30% and was ~20% lighter than the conventional antenna yet achieved substantially the same front-to-back ratio. In addition, its side lobe performance was improved which can be important in reduction of multipath signal reception. Because of its significant reduction in member count, the prototype of the invention would also generate significantly less wind loading so that its support structure can be simpler, lighter, less expensive and easier to install.

A further understanding of the concepts of the antenna 40 is facilitated with reference to FIG. 2 and to geometric optics theory which is especially applicable to large-aperture antennas. FIG. 2 is a cross section through the elongate members 46 in the upper half of the reflector 42 and illustrates an exemplary signal ray 80 that issues from the feed 44 and is incident on the reflector. Preferably, only a small portion 82 of the ray 80 is transmitted through the reflector and the remainder is reflected as a ray 84. The ratio of the transmitted portion to the incident ray is typically referred to as the transmission coefficient T.

Reflected rays such as the ray 84 contribute to radiation lobes in the front hemisphere of the antenna's radiation pattern (e.g., main lobe 62 and smaller lobes such as the lobe 65C in FIG. 4A). In contrast, transmitted rays such as the ray 82 contribute to radiation lobes in the rear hemisphere of the antenna's radiation pattern (e.g., rear lobe 64 and lobes 65A and 65E in FIG. 4A). Signal rays such as the ray 86 of FIG. 2 that pass near the antenna rim 48 are diffracted and also contribute to rear-hemisphere radiation lobes. Signal rays such as the ray 88 of FIG. 2 that pass by the antenna rim contribute to "spillover" radiation lobes (e.g., lobes 65B and 65E in FIG. 4A).

Because of various antenna parameters, the electromagnetic signal intensity is not constant across the reflector face.

In their effect on signal intensity, the most important of these parameters are the feed gain $G_{f_\theta}$ and the differential path loss $L_{d_\theta}$.

The feed gain $G_{f_\theta}$ is represented by the primary radiation pattern 90 in FIG. 2. The feed gain determines the signal intensity of the feed as a function of the angle θ from the paraboloidal vertex 52. For angles less than 90°, the feed gain of conventional feeds (as a function of angle relative to the peak gain) is typically described by $G_{f_\theta}=20 \log (\cos^n\theta)$ wherein n is in a range on the order of 1 to 10. The relative gain of the feed used to obtain the FIGS. 4A and 4B radiation patterns was substantially $G_{f_\theta}=20 \log (\cos^{1.3}\theta)$.

Figure 5:
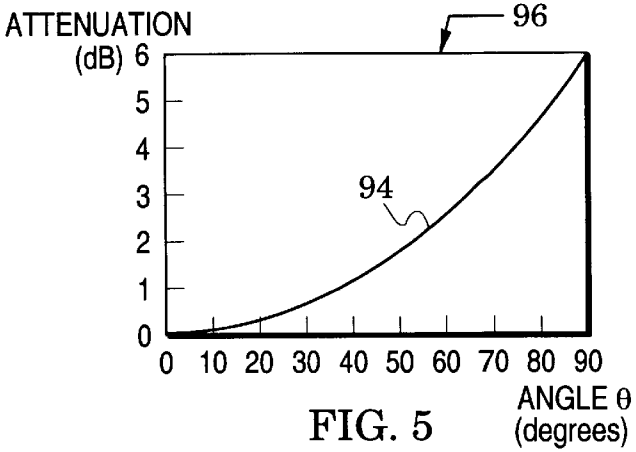
FIG. 5 is a graph that illustrates differential path attenuation in the reflector of FIGS. 1A and 1B.

Differential path loss is a result of the differing path lengths between the feed 44 and the reflector 42. This path length is least to the reflector vertex (52 in FIG. 2) and greatest to the reflector rim (48 in FIG. 1A). The differential path loss for paraboloidal reflectors is determined by the mathematical properties of a paraboloid. Accordingly, it is also a function of the angle θ and is expressed by $L_{d_\theta}=20 \log \{\sec^2 (\theta/2)\}$. This expression is shown as the plot 94 in the graph 96 of FIG. 5 and indicates that path loss can be appreciable for large angles θ.

It is well known that the front-to-back ratio F/B is given by $F/B=G_f-G_b$ in which $G_f$ and $G_b$ are respectively maximum antenna gains in the front and rear hemispheres. Because of paraboloidal mathematical properties, the front gain $G_f$, or equivalently the main lobe gain $G_{ml}$, is given by $G_{ml}=10 \log \{(4\pi A\eta)/\lambda^2\}$ in which A is the antenna's aperture area (i.e., area of the rim 48 of FIG. 1A) and η is a total aperture efficiency that is typically between 0.45 and 0.65.

In the present invention, it is recognized that the rear gain $G_b$ equals the feed gain $G_{f_\theta}$ less the differential path loss $L_{d_\theta}$ and the transmission coefficient $T_\theta$ and that these parameters vary with the angle θ. With substitution and rearrangement of above expressions, it is found generally that $F/B=G_f-G_{f_\theta}+L_{d_\theta}+T_\theta$ and (with the inclusion of equation (3) below) it is found specifically that, it is found that $$F/B = 10\log\frac{4\pi A\eta}{\lambda^2} - 10\log(\cos^{1.3}\theta) + 20\log\left(\sec^2\frac{\theta}{2}\right) + 10\log\left\{1 - \frac{1}{1+\frac{2S}{\lambda}\ln\frac{S}{\pi D}}\right\} \quad (1)$$

which can be solved to determine an angularly-varying transmission coefficient To that will realize a selected front-to-back ratio F/B (i.e., the general expression above can be rearranged to yield $T_\theta=F/B-G_{ml}+G_{f_\theta}-L_{d_\theta}$ in which main lobe gain $G_{ml}$ has been substituted for front gain $G_f$).

Figure 6:
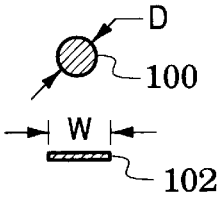
FIG. 6 illustrates exemplary cross sections of elongate members in the antenna of FIGS. 1A and 1B.

The transmission coefficient $T_\theta$ is related to the cross section of the elongate members (46 in FIGS. 1A and 1B) and their spacing (56 in FIGS. 1A and 1B). Two exemplary member cross sections 100 and 102 are shown in FIG. 6. The cylindrical cross section 100 has a diameter D and can be realized with various metallic wires whereas the cross section 102 has a width W and can be realized with various thin metallic strips. As shown, for example, in Jasik, Henry, *Antenna Engineering Handbook*, Mc-Graw Hill, Inc., New York, 1993, pp. 46-8 and 46-9, the transmission coefficient is given by $$T_\theta = 1 - \frac{1}{1+\left(\frac{2S}{\lambda}\ln\frac{S}{\pi D}\right)^2} \quad (2)$$

for the cross section 100 and by $$T_\theta = 1 - \frac{1}{1+\left(\frac{2S}{\lambda}\ln\left(\sin\frac{\pi W}{2S}\right)\right)^2} \quad (3)$$

for the cross section 102 (accordingly, $T_\theta$ equals 10 times the logarithm of the right side of equation (2) or of equation (3) when $T_\theta$ is expressed in decibels).

In the invention, these transcendental expressions can be solved to determine spaces S as a function of respective angles θ from the vertex (52 in FIG. 2). To facilitate reflector fabrication, the spaces S can then be converted to be a function of distance from the paraboloidal axis (50 in FIG. 2). The entries for location and space in FIG. 3 were converted in this manner.

The spacings of FIG. 3 can be approximated by quadratic equations such as $S(N)=AN^2+S_{min}$ in which A is a constant related to the feed taper, N is the number of the elongate members (beginning at the vertex) and $S_{min}$ is the spacing at the vertex that would obtain the selected front-to-back ratio based on the peak value of the feed gain. For the feed taper associated with FIG. 3, the constant A would have been 0.00089 and $S_{min}$ was 0.50 so that the relevant quadratic equation is $S(N)=0.00089N^2+0.50$. It is noted that $S_{min}$ is the constant grid spacing that is typically found in conventional paraboloidal grid antennas.

Figure 7:
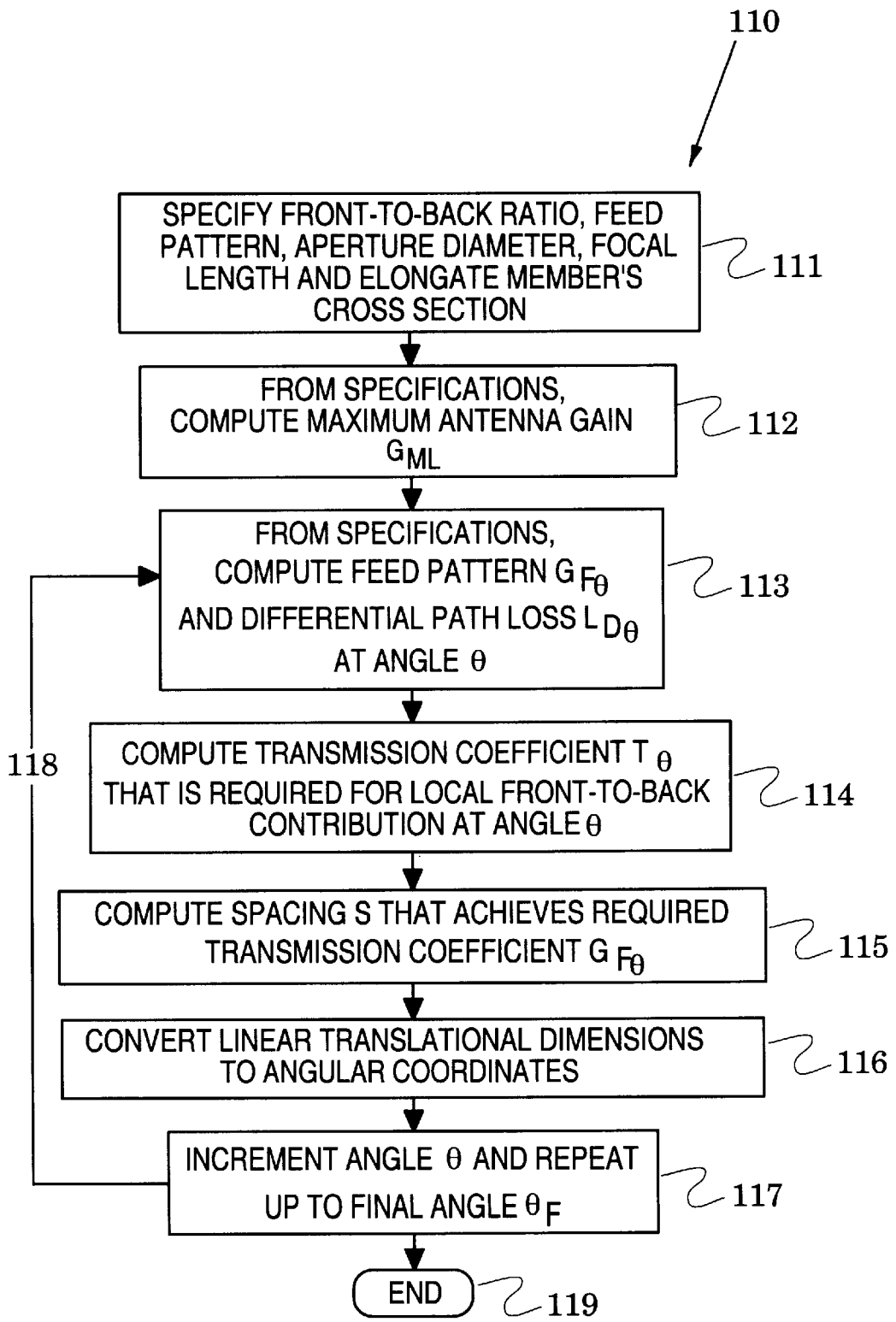
FIG. 7 is a flow chart that shows an exemplary design procedure for the present invention.

For practicing the teachings of the invention, an exemplary design procedure is shown in the flow chart 110 of FIG. 7. In a first design step 111, a front-to-back ratio, a feed pattern, an aperture diameter, a focal length and an elongate-member cross section are specified. From those specifications, the antenna gain $G_{ml}$ is computed in step 112 and the feed pattern $G_{f_\theta}$ and the differential path loss $L_{d_\theta}$ at an angle θ are computed in design step 113.

Computation is next performed in step 114 to find the transmission coefficient $T_\theta$ that is required to obtain the front-to-back ratio at the angle θ. Step 115 calculates the spacing S that achieves the transmission coefficient $T_\theta$ of step 114. Linear dimensions are converted in step 116 to angular coordinates and, with this result, the angle θ is incremented in step 117 to a new value. As indicated by the feedback path 118, the new value of θ is used to repeat design steps 113–117. This process is repeated up to a final angle $\theta_f$ (e.g., the angle of the rim member 46R in FIG. 2). The design procedure is then complete as indicated by the termination 119.

Figure 8:
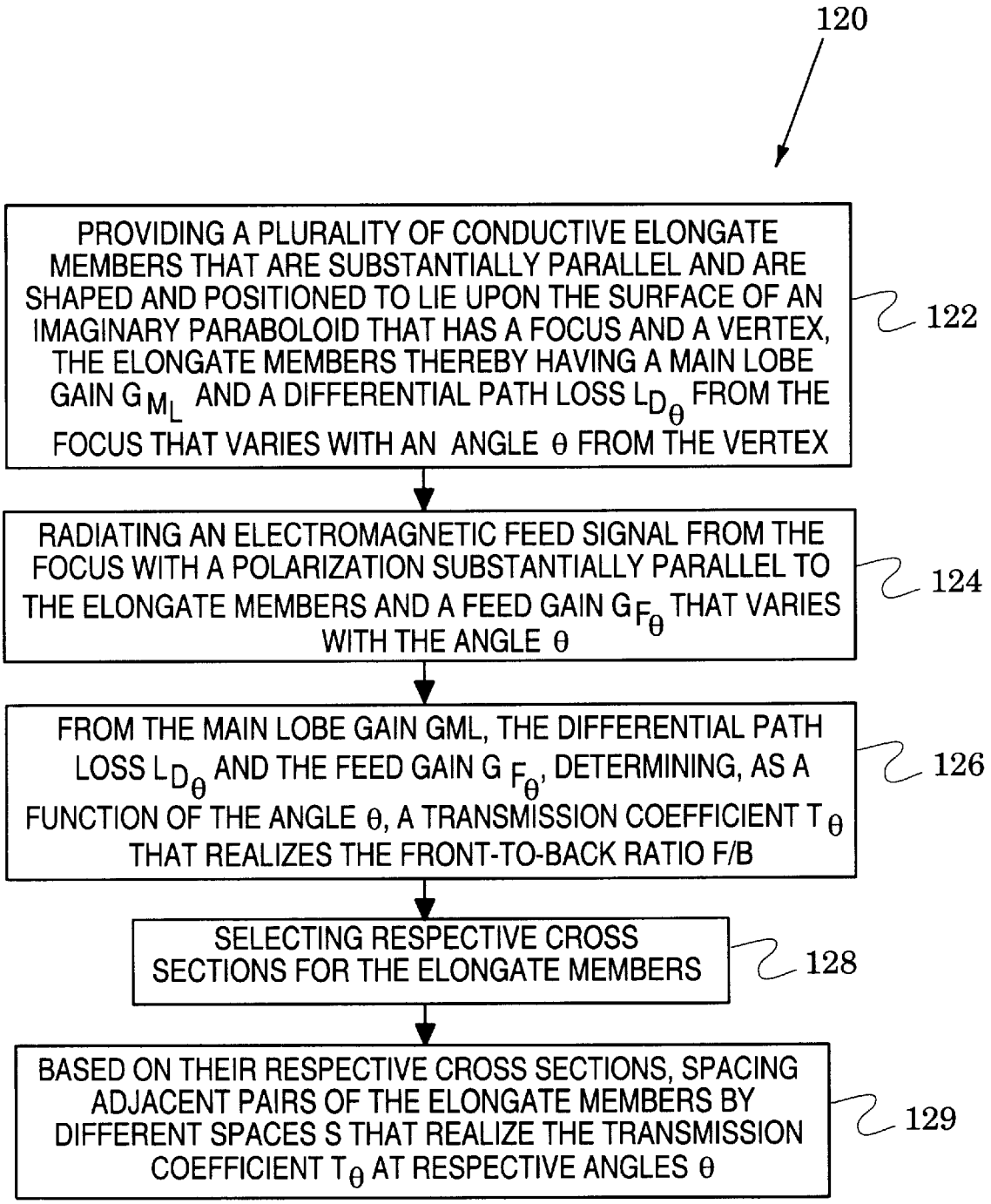
FIG. 8 is a flow chart that shows conceptual process steps of the present invention.

These teachings are conceptually summarized in the flow chart 120 of FIG. 8 which is directed to a method of transmitting electromagnetic energy with a wavelength λ to realize a front-to-back ratio F/B of main lobe gain to rear lobe gain. It includes a step 122 that provides a plurality of conductive elongate members that are substantially parallel and are shaped and positioned to lie upon the surface of an imaginary paraboloid that has a focus and a vertex. Accordingly, the elongate members have a main lobe gain $G_{ml}$ and a differential path loss $L_{d_\theta}$ from the focus that varies with an angle θ from the vertex.

In a second process step 124, an electromagnetic feed signal is radiated from the focus with a polarization substantially parallel to the elongate members and a feed gain $G_{f_\theta}$ that varies with the angle θ. From the main lobe gain $G_{ml}$, the differential path loss $L_{d_\theta}$ and the feed gain $G_{f_\theta}$, and as a function of the angle θ, a transmission coefficient $T_\theta$ is determined in step 126 that realizes the front-to-back ratio F/B.

In process step 128, respective cross sections are selected for the elongate members. Based on their respective cross sections, adjacent pairs of the elongate members are spaced in step 129 by different spaces S that realize the transmission coefficient $T_\theta$ at respective angles θ.

The steps of FIG. 7 were used in designing the prototype antenna whose radiation pattern is shown in FIG. 5A. The feed for this antenna was a dipole and in accordance with design step 113, it was found that the feed gain was substantially described by 20 $\log(\cos^{1.3}\theta)$ but contained ripple components. This component was included in the feed gain $G_{f_\theta}$ and accordingly, the intermember spaces of FIG. 3 mimicked the ripple so that they increased with distance from the paraboloidal axis (50 in FIG. 3) but not with a constantly increasing rate.

The conceptual structure of the invention can be supplemented with various support structures. The rim 48 and support members 130 are both added in FIGS. 1A and 1B, for example, to provide structural support for the elongate members 46. Other structures can be added for feed and reflector interconnection and for antenna mounting (e.g., feed interconnection 132 and mount 134 structures are indicated in broken lines in FIG. 1B).

Figure 9B:
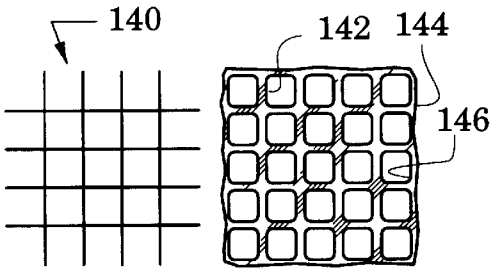
FIG. 9B illustrates different embodiments of elongate members in the antenna of FIGS. 1A and 1B.
Figure 9A:
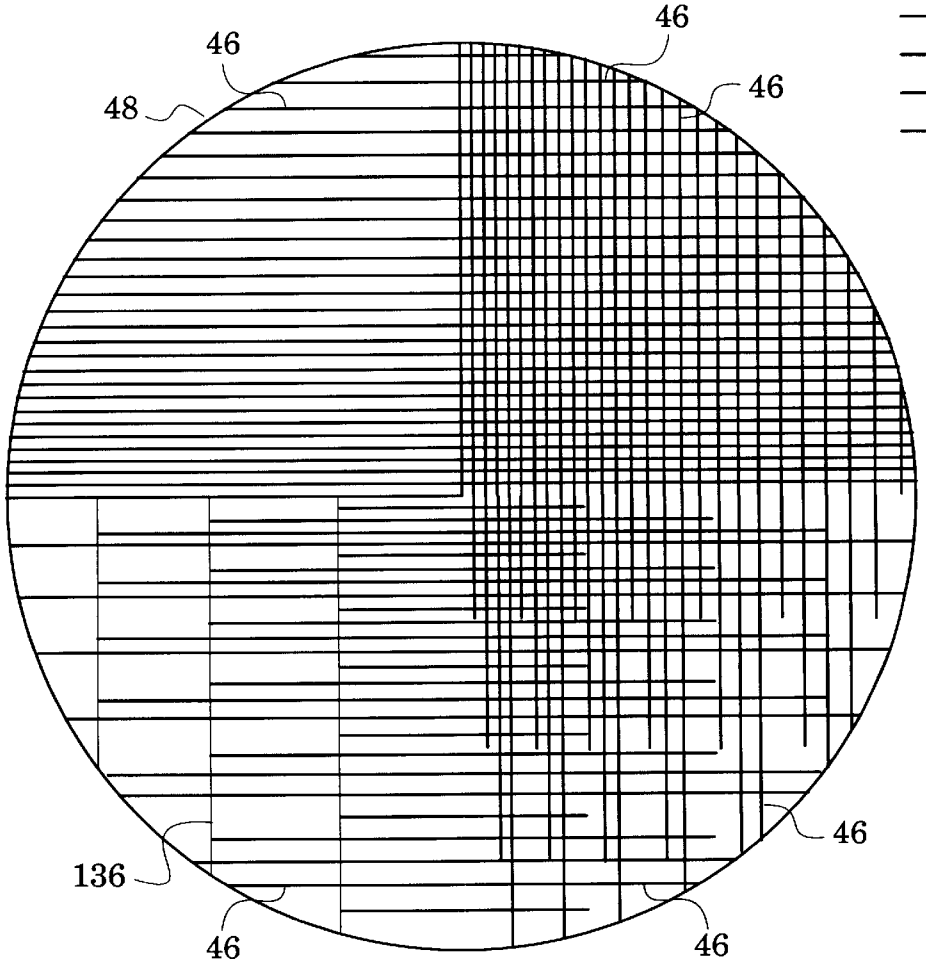
FIG. 9A is a view similar to FIG. 1A that illustrates other embodiments of the present invention.

To facilitate a description of other reflector embodiments, the elongate members 46 and rim 48 of FIG. 1A are shown again in the upper left quadrant of FIG. 9A. The invention can be extended to address multiple signals with different polarizations or signals made up of different polarizations (e.g., circular polarization). This is accomplished in the upper right quadrant of FIG. 9A by duplicating the structure in the upper left quadrant, rotating it to a different orientation and adding it to the original structure.

The lower left quadrant of FIG. 9A repeats the upper left quadrant but selectively terminates elongate members at support members 136 so that the spacing between elongate members increases with distance from the vertex (52 in FIG. 1B) both along the elongate members and along a direction normal to the elongate members. The structure in the lower right quadrant combines the teachings of the upper right and lower left quadrants.

For generality, the elements 46 of FIGS. 1A, 1B and 2 have been referred to as "elongate members" but it should be apparent that these elements are often referred to as "grids" in the prior art. A prototype of the invention has been realized with metallic wires for the elongate members but they can be realized with various elements. For example, FIG. 9B illustrates a portion 140 of the members in the upper right quadrant of FIG. 9A and shows that these can also be realized with members 142 of a perforated sheet 144 that defines a plurality of apertures 146.

Although the invention has been described with elongate members that have a common cross section, the invention may also be practiced with members that have different cross sections by including this difference when finding respective transmission coefficients $T_\theta$.

Member locations and spaces have generally been given in inches in the above description but can be converted to other dimensional systems (e.g., to centimeters) by appropriate conversions.

The preferred embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A reflector for reflecting an electromagnetic feed signal to realize a front-to-back ratio F/B of main lobe gain to rear lobe gain wherein said feed signal has a polarization, a wavelength λ and a feed gain $G_{f_\theta}$ that angularly varies, the reflector comprising:

a plurality of conductive elongate members which are substantially parallel and aligned with said polarization and are shaped and positoned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex;

wherein said elongate members are positioned so that said feed gain $G_{f_\theta}$ varies with said angle θ;

wherein said main lobe gain $G_{ml}$, said differential path loss $L_{d_\theta}$ and said feed gain $G_{f_\theta}$, determine as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ and with respective cross sections; and wherein said transmission coefficient $T_\theta$ is in accordance with $T_\theta = F/B - G_{ml} + G_{f_\theta} - L_{d_\theta}$.

2. The reflector of claim 1, wherein all of said elongate members have the same cross section.

3. The reflector of claim 1, wherein at least two of said spaces S are different.

4. The reflector of claim 1, wherein a contiguous majority of said spaces S are different.

5. The reflector of claim 1, wherein said spaces S increase with increase in said angle θ.

6. The reflector of claim 1, wherein said members are metallic wires.

7. The reflector of claim 1, further including a metallic sheet that defines a plurality of apertures and wherein said members are portions of said sheet between said apertures.

8. The reflector of claim 1, wherein each of said cross sections has a diameter D and said transmission constant $T_\theta$ is in accordance with $T_\theta = 10 \log \{1 - 1/\{1 + ((2S/\lambda) \ln (S/\pi D))^2\}\}$.

9. The reflector of claim 1, wherein said paraboloid has an axis through said focus and said vertex, each of said cross sections has a width W and said transmission constant $T_\theta$ is in accordance with $T_\theta = 10 \log \{1 - 1/\{1 + ((2S/\lambda) \ln (\sin (\pi W/2S))^2\}\}$.

10. An antenna for radiating an electromagnetic feed signal to realize a front-to-back ratio F/B of main lobe gain to rear lobe gain, comprising:

a plurality of conductive elongate members which are substantially parallel and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex; and a feed positioned at said focus and configured to radiate a feed signal that has a wavelength λ, a feed gain $G_{f_\theta}$ that varies with said angle θ and a polarization that is substantially aligned with said elongate members;

wherein said main lobe gain $G_{ml}$, said differential path loss $L_{dq}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and a substantially constant for a contiguous minority that typically adjoins said vertex to realize said transmission coefficient $T_\theta$ at respective angles θ and with respective cross sections;

and wherein said transmission coefficient $T_\theta$ is in accordance with $T_\theta=F/B-G_{ml}+G_{f_\theta}-L_{d_\theta}$.

11. The antenna of claim 10, wherein each of said cross sections has a diameter D and said transmission constant $T_\theta$ is in accordance with $T_\theta=10 \log \{1-1/\{1+((2S/\lambda) \ln (S/\pi D))^2\}\}$.

12. The reflector of claim 10, wherein said paraboloid has an axis through said focus and said vertex, each of said cross sections has a width W and said transmission constant $T_\theta$ is in accordance with $T_\theta=10 \log \{1-1/\{1+((2S/\lambda) \ln (\sin (\pi W/2S))^2\}\}$.

13. The antenna of claim 10, wherein all of said elongate members have the same cross section.

14. The antenna of claim 10, wherein at least two of said spaces S are different.

15. The antenna of claim 10, wherein a contiguous majority of said spaces S are different.

16. The antenna of claim 10, wherein said spaces S increase with increase in said angle θ.

17. The antenna of claim 10, wherein said members are metallic wires.

18. The antenna of claim 10, wherein said feed is a waveguide horn.

19. The antenna of claim 10, wherein said feed comprises a dipole and a reflector member spaced from said dipole.

20. The antenna of claim 10, further including a shell that defines a plurality of apertures and wherein said members are portions of said shell between said apertures.

21. A reflector for reflecting an electromagnetic feed signal to realize a front-to-back ratio F/B of main lobe gain to rear lobe gain wherein said feed signal has a polarization, a wavelength λ and a feed gain $G_{f_\theta}$ that angularly varies, the reflector comprising:

a plurality of conductive elongate members which are substantially parallel and aligned with said polarization and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex;

wherein said elongate members are positioned so that said feed gain $G_{f_\theta}$ varies with said angle θ;

wherein said main lobe gain $G_{ml}$, said differential path loss $L_{d_\theta}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ and with respective cross sections;

and wherein said main lobe gain is substantially in accordance with $G_{ml}=10 \log \{(4\pi A\eta)/\lambda^2\}$ wherein A is the area of said paraboloid and η is a total aperture efficiency that is substantially between 0.45 and 0.65.

22. A reflector for reflecting an electromagnetic feed signal to realize a front-to-back ratio F/B of main lobe gain to rear lobe gain wherein said feed signal has a polarization, a wavelength λ and a feed gain $G_{f_\theta}$ that angularly varies, the reflector comprising:

a plurality of conductive elongate members which are substantially parallel and aligned with said polarization and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex;

wherein said elongate members are positioned so that said feed gain $G_{f_\theta}$ varies with said angle θ;

wherein said main lobe gain $G_{ml}$, said differential path loss $L_{d_\theta}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ and with respective cross sections;

and wherein said differential path loss $L_{d_\theta}$ is substantially in accordance with $L_{d_\theta}=20 \log \{\sec^2 (\theta/2)\}$.

23. A reflector for reflecting an electromagnetic feed signal to realize a front-to-back ratio F/B of main lobe gain to rear lobe gain wherein said feed signal has a polarization, a wavelength λ and a feed gain $G_{f_\theta}$ that angularly varies, the reflector comprising:

a plurality of conductive elongate members which are substantially parallel and aligned with said polarization and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex;

wherein said elongate members are positioned so that said feed gain $G_{f_\theta}$ varies with said angle θ;

wherein said main lobe gain $G_{ml}$, said differential path loss $L_{d_\theta}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pair and are substantially constant for a contiguous minority that typically adjoins said vertex to realize said transmission coefficient $T_\theta$ at respective angles θ and with respective cross sections;

and wherein said feed gain $G_{f_\theta}$ is substantially in accordance with $G_{f_\theta}=20 \log (\cos^n\theta)$ in which n is between 1 and 10.

24. An antenna for radiating an electromagnetic feed signal to realize a front-to-back ratio F/B of main lobe gain to rear lobe gain, comprising:

a plurality of conductive elongate members which are substantially parallel and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex; and a feed positioned at said focus and configured to radiate a feed signal that has a wavelength λ, a feed gain $G_{f_\theta}$ that varies with said angle θ and a polarization that is substantially aligned with said elongate members;

wherein said main lobe gain $G_{ml}$, said differential path loss $L_{dq}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ and with respective cross sections;

and wherein said main lobe gain is substantially in accordance with $G_{ml}=10 \log \{(4\pi A\eta)/\lambda^2\}$ wherein A is the area of said paraboloid and η is a total aperture efficiency that is substantially between 0.45 and 0.65.

25. An antenna for radiating an electromagnetic feed signal to realize a front-to-back ratio F/B of main lobe gain to rear lobe gain, comprising:

a plurality of conductive elongate members which are substantially parallel and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex; and a feed positioned at said focus and configured to radiate a feed signal that has a wavelength λ, a feed gain $G_{f_\theta}$ that varies with said angle θ and a polarization that is substantially aligned with said elongate members;

wherein said main lobe gain $G_{ml}$, said differential path loss $L_{dq}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pair and are substantially constant for a contiguous minority that typically adjoins said vertex to realize said transmission coefficient $T_\theta$ at respective angles θ and with respective cross sections;

and wherein said differential path loss $L_{d_\theta}$ is substantially in accordance with $L_{d_\theta}=20 \log \{(\sec^2 (\theta/2)\}$.

26. An antenna for radiating an electromagnetic feed signal to realize a front-to-back ratio F/B of main lobe gain to rear lobe gain, comprising:

a plurality of conductive elongate members which are substantially parallel and are shaped and positioned to lie upon the surface of an imaginary paraboloid with a focus and a vertex, said elongate members thereby having a main lobe gain $G_{ml}$ and a differential path loss $L_{d_\theta}$ from said focus that varies with an angle θ from said vertex; and a feed positioned at said focus and configured to radiate a feed signal that has a wavelength λ, a feed gain $G_{f_\theta}$ that varies with said angle θ and a polarization that is substantially aligned with said elongate members;

wherein said main lobe gain $G_{ml}$, said differential path loss $L_{dq}$ and said feed gain $G_{f_\theta}$, determine, as a function of said angle θ, a transmission coefficient $T_\theta$ that realizes said front-to-back ratio F/B;

wherein said members have respective cross sections and adjacent pairs of said members are spaced apart by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ and with respective cross sections;

and wherein said feed gain $G_{f_\theta}$ is substantially in accordance with $G_{f_\theta}=20 \log (\cos^n\theta)$ in which n is between 1 and 10.

27. A method of transmitting electromagnetic energy with a wavelength λ to realize a front-to-back ratio F/B of main lobe gain to rear lobe gain, the method comprising the steps of:

providing a plurality of conductive elongate members that are substantially parallel and are shaped and positioned to lie upon the surface of an imaginary paraboloid that has a focus and a vertex, said elongate members thereby having a main lobe gain $G_{ml}$ and a differential path loss $L_{d_\theta}$ from said focus that varies with an angle θ from said vertex;

radiating an electromagnetic feed signal from said focus with a polarization substantially parallel to said elongate members and a feed gain $G_{f_\theta}$ that varies with said angle θ;

from said main lobe gain $G_{ml}$, said differential path loss $L_{d_\theta}$ and said feed gain $G_{f_\theta}$, determining, as a function of said angle θ, a transmission coefficient $T_\theta$ that realizes said front-to-back ratio F/B;

selecting respective cross sections for said elongate members; and based on their respective cross sections, spacing adjacent pairs of said elongate members by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ;

wherein said transmission coefficient $T_\theta$ is in accordance with $T_\theta=F/B-G_{ml}+G_{f_\theta}-L_{d_\theta}$.

28. The method of claim 27, wherein all of said elongate members have the same cross section.

29. The method of claim 27, wherein at least two of said spaces S are different.

30. The method of claim 27, wherein all of said spaces S are different.

31. The method of claim 27, wherein said spaces S increase with increase in said angle θ.

32. The method of claim 27, wherein said cross sections have a diameter D and said transmission constant $T_\theta$ is in accordance with $T_\theta=10 \log \{1-1/\{1+((2S/\lambda) \ln (S/\pi D))^2\}\}$.

33. The reflector of claim 27, wherein said paraboloid has an axis through said focus and said vertex, said cross sections have a width W parallel to said axis and said transmission constant $T_\theta$ is in accordance with $T_\theta=10 \log \{1-1/\{1+((2S/\lambda) \ln (\sin (\pi W/2S))^2\}\}$.

34. A method of transmitting electromagnetic energy with a wavelength λ to realize a front-to-back ratio F/B of main lobe gain to rear lobe gain, the method comprising the steps of:

providing a plurality of conductive elongate members that are substantially parallel and are shaped and positioned to lie upon the surface of an imaginary paraboloid that has a focus and a vertex, said elongate members thereby having a main lobe gain $G_{ml}$ and a differential path loss $L_{d_\theta}$ said focus that varies with an angle θ from said vertex;

radiating an electromagnetic feed signal from said focus with a polarization substantially parallel to said elongate members and a feed gain $G_{f_\theta}$ that varies with said angle θ;

from said main lobe gain $G_{ml}$, said differential path loss $L_{d_\theta}$ and said feed gain $G_{f_\theta}$, determining, as a function of said angle θ, a transmission coefficient $T_\theta$ that realizes said front-to-back ratio F/B;

selecting respective cross sections for said elongate members; and based on their respective cross sections, spacing adjacent pairs of said elongate members by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ;

wherein said main lobe gain is substantially in accordance with $G_{ml}=10 \log \{(4\pi A\eta)/\lambda^2\}$ wherein A is the area of said paraboloid and η is a total aperture efficiency that is substantially between 0.45 and 0.65.

35. A method of transmitting electromagnetic energy with a wavelength λ to realize a front-to-back ratio F/B of main lobe gain to rear lobe gain, the method comprising the steps of:

providing a plurality of conductive elongate members that are substantially parallel and are shaped and positioned to lie upon the surface of an imaginary paraboloid that has a focus and a vertex, said elongate members thereby having a main lobe gain $G_{ml}$ and a differential path loss $L_{d_\theta}$ from said focus that varies with an angle θ from said vertex;

radiating an electromagnetic feed signal from said focus with a polarization substantially parallel to said elongate members and a feed gain $G_{f_\theta}$ that varies with said angle θ;

from said main lobe gain $G_{ml}$, said differential path loss $L_{d_\theta}$ and said feed gain $G_{f_\theta}$, determining, as a function of said angle θ, a transmission coefficient $T_\theta$ that realizes said front-to-back ratio F/B;

selecting respective cross sections for said elongate members; and based on their respective cross sections, spacing adjacent pairs of said elongate members by different spaces S wherein said spaces S increase with increased angle θ for a contiguous majority of adjacent pairs and are substantially constant for a contiguous minority that typically adjoins said vertex to realize said transmission coefficient $T_\theta$ at respective angles θ;

wherein said differential path loss $L_{d_\theta}$ is substantially in accordance with $L_{d_\theta}=20 \log \{\sec^2 (\theta/2)\}$.

36. A method of transmitting electromagnetic energy with a wavelength λ to realize a front-to-back ratio F/B of main lobe gain to rear lobe gain, the method comprising the steps of:

providing a plurality of conductive elongate members that are substantially parallel and are shaped and positioned to lie upon the surface of an imaginary paraboloid that has a focus and a vertex, said elongate members thereby having a main lobe gain $G_{ml}$ and a differential path lose $L_{d_\theta}$ from said focus that varies with an angle θ from said vertex;

radiating an electromagnetic feed signal from said focus with a polarization substantially parallel to said elongate members and a feed gain $G_{f_\theta}$ that varies with said angle θ;

from said main lobe gain $G_{ml}$, said differential path loss $L_{d_\theta}$ and said feed gain $G_{f_\theta}$, determining, as a function of said angle θ, a transmission coefficient $T_\theta$ that realizes said front-to-back ratio F/B;

selecting respective cross sections for said elongate members; and based on their respective cross sections, spacing adjacent pairs of said elongate members by different spaces S wherein said spaces S wherein said spaces S increase with increased angle θ for a contiguous majority of adjacent pairs and are substantially constant for a contiguous minority that typically adjoins said vertex to realize said transmission coefficient $T_\theta$ at respective angles θ;

$G_{f_\theta}=20 \log (\cos^{1.3}\theta)$.

* * * * *